US005758871A

United States Patent [19]

Schlough

[11] Patent Number: 5,758,871

[45] Date of Patent: Jun. 2, 1998

[54] SIGNATURE COLLATING APPARATUS

[75] Inventor: James R. Schlough, Troy, Ohio

[73] Assignee: Heidelberg Finishing Systems, Inc., Dayton, Ohio

[21] Appl. No.: 720,197

[22] Filed: Sep. 25, 1996

[51] Int. Cl.[6] ..... B65H 39/00

[52] U.S. Cl. ..... 270/52.27

[58] Field of Search ..... 270/52.26, 52.27, 270/52.29, 52.3

[56] References Cited

U.S. PATENT DOCUMENTS

| | | | |
|---|---|---|---|
| 4,050,686 | 9/1977 | McCain et al. | 270/50.09 |
| 4,489,930 | 12/1984 | Meier | 270/52.3 |
| 4,811,938 | 3/1989 | Hansch | 270/52.27 |
| 4,901,996 | 2/1990 | Schlough | 271/10.06 |
| 4,976,420 | 12/1990 | Flensburg et al. | 271/100 |
| 5,013,022 | 5/1991 | Graushar | 271/4 |
| 5,137,409 | 8/1992 | Honegger | 281/15.1 |
| 5,248,135 | 9/1993 | Leu | 271/204 |
| 5,277,413 | 1/1994 | Boss | 270/52.3 |
| 5,292,111 | 3/1994 | Hansch | 271/247 |
| 5,354,043 | 10/1994 | Reist | 271/204 |
| 5,474,285 | 12/1995 | Stauber | 270/52.24 |
| 5,474,286 | 12/1995 | Reist | 270/52.25 |
| 5,657,978 | 8/1997 | Meier et al. | 270/52.16 |

*Primary Examiner*—David A. Okonsky

*Attorney, Agent, or Firm*—Tarolli, Sundheim, Covell, Tummino & Szabo

[57] ABSTRACT

A signature handling apparatus includes a plurality of saddles and a plurality of signature openers. Each signature opener is associated with a respective saddle. The signature openers move together with the saddles in a first direction along an endless path past a signature feeding mechanism with the saddles extending transversely to the first direction. Each signature opener opens one respective signature as the signature opener moves past the signature feeding mechanism to enable positioning of the one signature in an opened condition on the saddle associated with the signature opener.

14 Claims, 5 Drawing Sheets

SIGNATURE COLLATING APPARATUS

BACKGROUND OF THE INVENTION

1. Technical Field

The present invention relates to a signature handling apparatus In particular, the present invention relates to an apparatus for collating signatures.

2. Description of the Prior Art

In a known apparatus for collating signatures a saddle conveyor moves a plurality of saddles sequentially past a plurality of signature feeders, each of which includes a signature opener mechanism. The signature opener mechanism opens a signature and deposits the signature onto a saddle moving past the opener mechanism. As the saddles move past the feeders, a collated assemblage of signatures is formed on the saddle.

SUMMARY OF THE INVENTION

The present invention is an apparatus comprising a plurality of saddles for receiving signatures from a plurality of signature feeding mechanisms. The apparatus also includes a plurality of signature openers. Each one of the signature openers is associated with a respective one of the saddles. The apparatus includes means for moving the signature openers together with the saddles in a first direction along an endless path past the signature feeding mechanisms with the saddles extending transversely to the first direction. Each one of the signature openers has means for opening one respective signature as the one signature opener moves past a signature feeding mechanism to enable positioning of the one signature in an opened condition on the saddle associated with the one signature opener.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF A PREFERRED EMBODIMENT OF THE INVENTION

Figure 1:
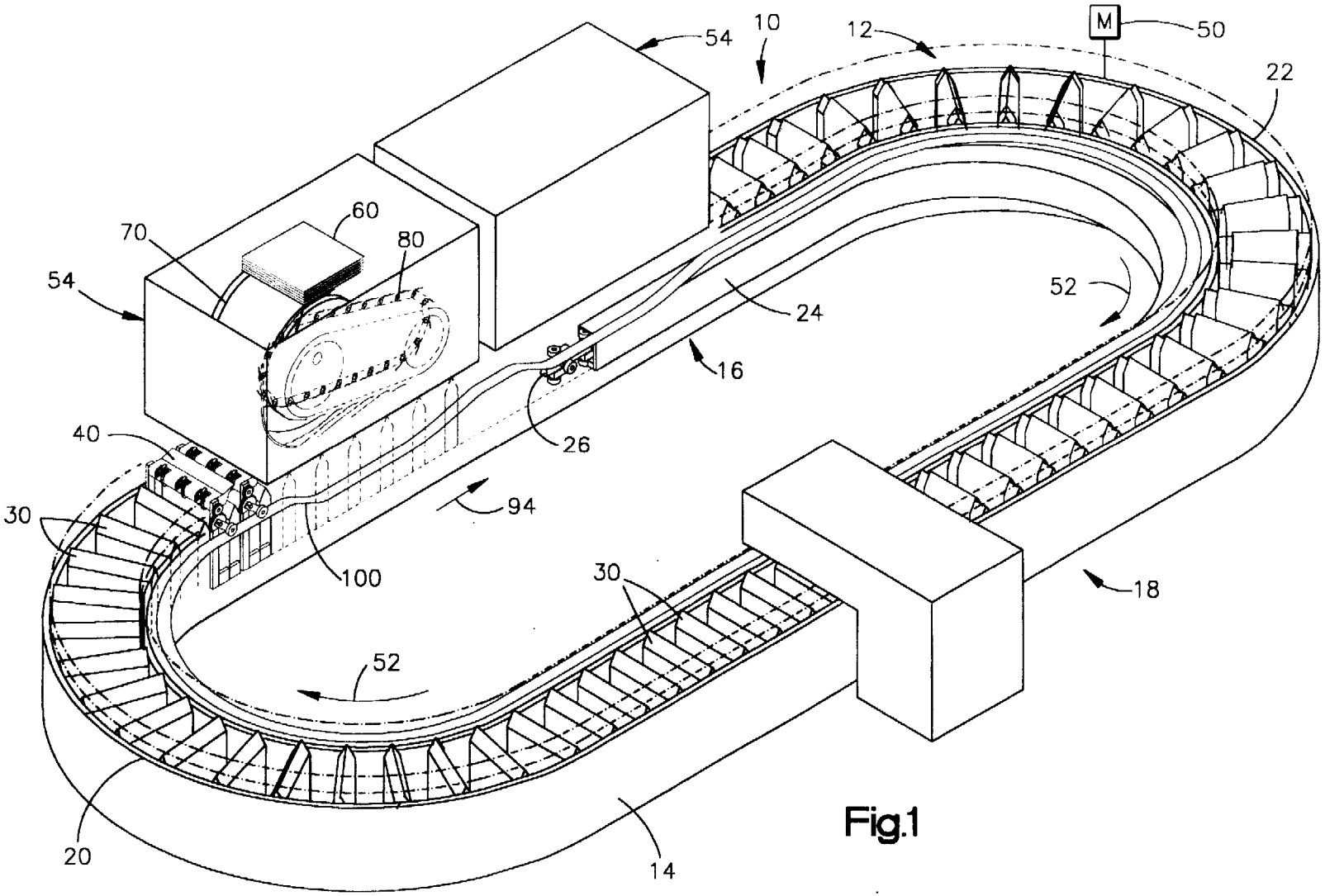
FIG. 1 is a schematic illustration of a signature handling apparatus constructed in accordance with the present invention.

The present invention relates to a signature collating apparatus. The present invention is applicable to various signature collating apparatus constructions. As representative of the present invention, FIG. 1 illustrates a signature collating apparatus 10.

The apparatus 10 includes an oval collating conveyor or saddle conveyor 12, mounted in a frame 14 for horizontal movement. The conveyor 12 has two parallel, linear portions 16 and 18 which are straight and are joined by curved end portions 20 and 22, so that the conveyor is a closed loop conveyor. A support rail 24 runs along the length of the conveyor 12.

Figure 2:
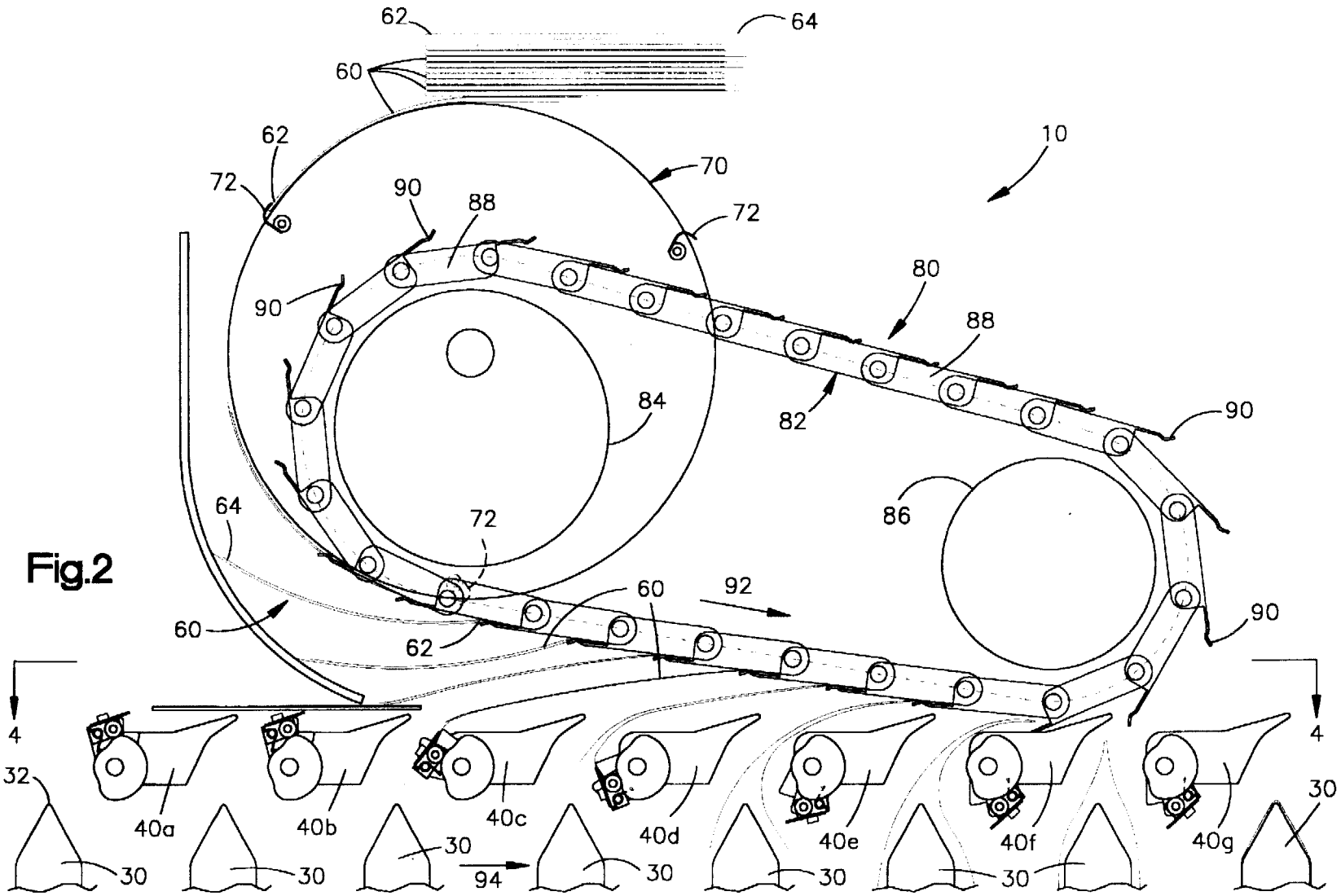
FIG. 2 is a schematic illustration of a portion of the apparatus of FIG. 1 showing a plurality of saddles and their associated signature openers.

The conveyor 12 includes a plurality of interconnected links 26 supported for movement on the support rail 24. Mounted on each link 26 is a support bar or saddle 30 for supporting folded signatures. The saddles 30 are spaced from each other at uniform intervals of a predetermined first distance along the length of the conveyor 12. Each saddle 30 has an upstanding configuration with a triangular apex 32 (FIG. 2).

Figure 3:
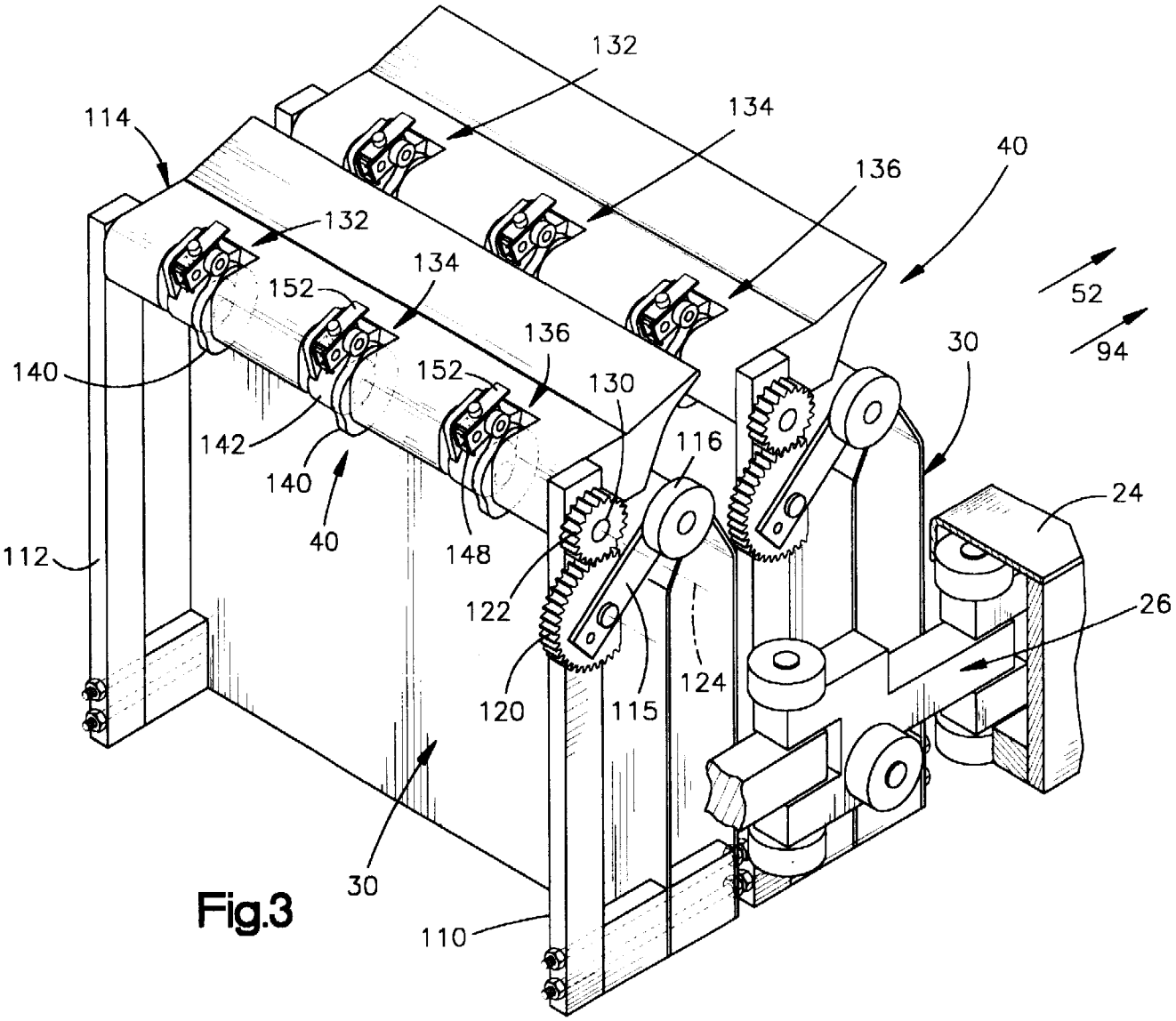
FIG. 3 is a perspective view of two of the saddles and their associated signature openers.
Figure 4:
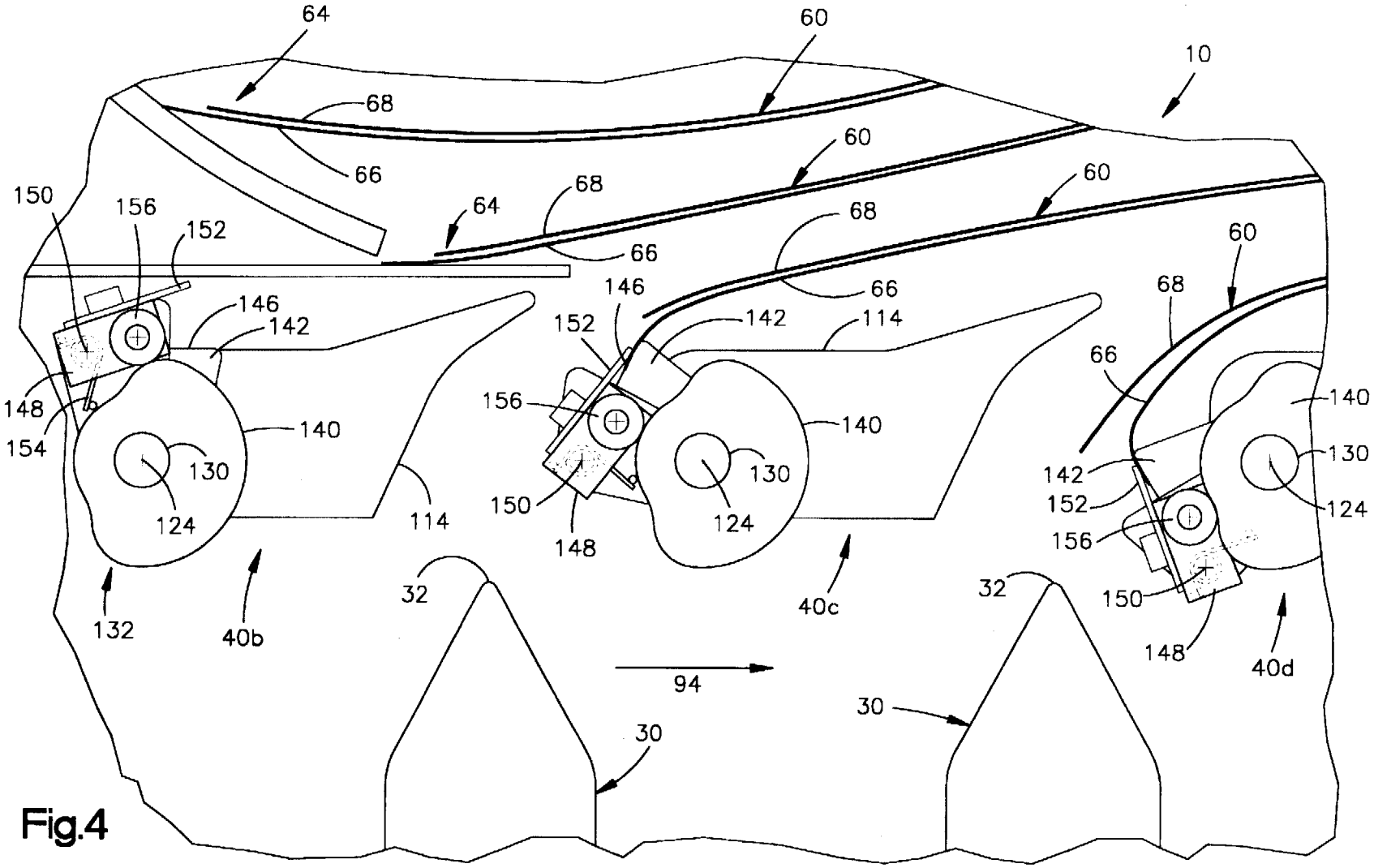
FIG. 4 is an enlarged view similar to FIG. 2 showing signature openers in sequential operating positions.

Also mounted on each link 26 is a respective signature opener 40, described below in detail. Each one of the signature openers 40 is associated with one of the saddles 30 and is fixed for movement with its associated saddle. The signature openers 40 are spaced apart from each other at uniform intervals of the first distance, that is, the same distance which separates adjacent saddles 30. The signature openers 40 which are shown in FIGS. 2–4, are given the reference numerals 40*a*, 40*b*, 40*c*, 40*d*, 40*e*, 40*f*, and 40*g*. The signature openers 40*a*–40*g*, along with all the other signature openers 40, are identical to each other. In FIG. 1, for clarity, not all the signature openers 40 are shown.

The conveyor 12 includes drive means, such as a motor indicated schematically at 50, for moving the links 26, and thereby the saddles 30 and the signature openers 40, along an endless path indicated by the arrow 52. The drive means 50 is operable to move the saddles 30 along the path 52 at a predetermined first speed. The saddles 30 move along the path 52 with their longitudinal axes extending perpendicular to the direction of movement of the saddles. The signature openers 40 move along the path 52, together with the saddles 30, at the first speed.

Mounted along the linear portion 16 of the conveyor 12 are two identical signature feed stations 54. There may be a different number of signature feed stations as determined by the operating requirements of the apparatus 10 and the type of signature assemblies being collated.

Figure 5:
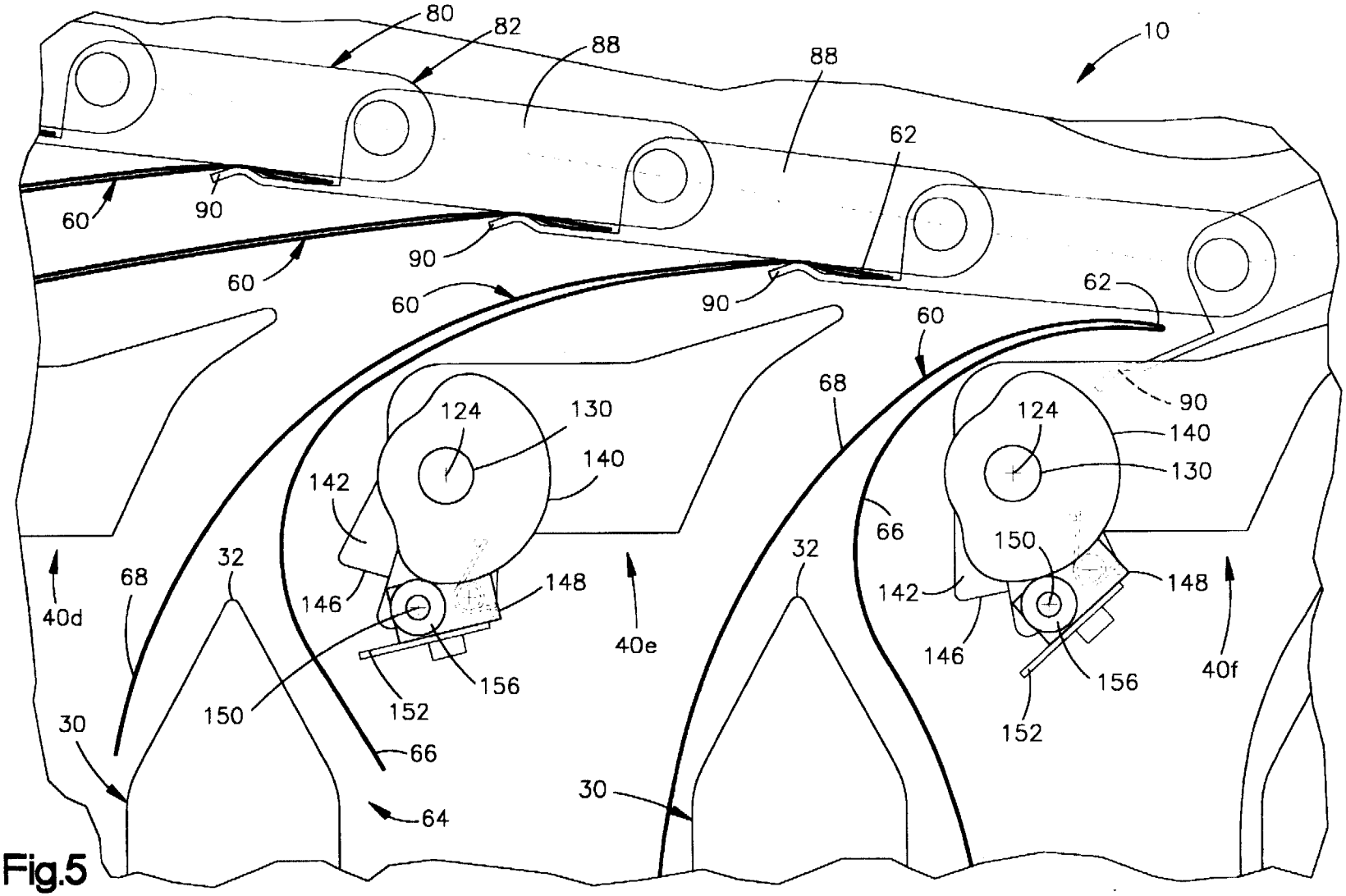
FIG. 5 is a view similar to FIG. 4 showing signature openers in further sequential operating positions.

Each signature feed station 54 includes a stack of folded signatures 60 and a gripper drum 70. Each one of the signatures 60 has a folded, edge portion 62 (FIGS. 2 and 5), an opposite lap edge 64, a long lap 66 (FIG. 4), and a short lap 68.

The gripper drum 70 (FIG. 2) is of a known construction. The gripper drum 70 includes a plurality of grippers 72 for gripping a signature 60. The gripper drum 70 is driven for rotation in a counter-clockwise direction as viewed in FIG. 2. The signatures 60 are gripped by the gripper drum 70 with the folded edge portion 62 of each signature leading relative to the direction of rotation of the gripper drum.

The apparatus 10 includes a gripper loop 80. The gripper loop 80 includes a chain 82 which extends around first and second drive wheels or sprockets 84 and 86. The chain 82 includes a plurality of links 88. On the trailing end of each link 88 is located a gripper 90. Each gripper 90 moves between an open position and a closed position as the chain 82 moves around the sprockets 84 and 86.

The grippers 90 on the gripper loop 80 are spaced apart from each other at uniform intervals of a predetermined second distance. The second distance is a predetermined fraction of the first distance, that is, of the distance between adjacent signature openers 40 on the conveyor 12. In the illustrated embodiment, the second distance is 50% of the first distance. Thus, adjacent signature openers 40 on the conveyor 12 are twice as far apart as are adjacent grippers 90 on the gripper loop 80.

The chain 82 is driven in a counter-clockwise direction as viewed in FIG. 2. The chain 82 moves the grippers 90 at a predetermined second speed. The second speed is a predetermined fraction of the first speed, that is, of the speed of movement of the signature openers 40 on the conveyor 12. The ratio of the first speed to the second speed is the same as the ratio of the first distance to the second distance. In the illustrated embodiment, the second speed is 50% of the first speed. Thus, the signature openers 40 on the conveyor 12 move at twice the speed of the grippers 90 on the gripper loop 80.

The gripper loop 80 is disposed adjacent to the gripper drum 70 for receiving signatures 60 from the gripper drum. The signatures 60 are gripped by the gripper loop 80 with the folded edge portions 62 of the signatures leading relative to the direction of movement of the gripper loop adjacent the openers 40, which direction is indicated by the arrow 92. The signature folded edge portions 62 also lead relative to the direction of movement of the conveyor 12 past the feed stations 54, which direction is indicated by the arrow 94.

A stationary cam 100 (FIG. 1) extends along a portion of the conveyor 12, at a location adjacent to the feed stations 54. The stationary cam 100 has a predetermined profile along the length of each feed station 54 for controlling, in a manner described below, the operation of the signature openers 40.

Each signature opener 40 (FIG. 3) includes a pair of upstanding supports 110 and 112 which extend parallel to the vertical direction of the saddle 30. An opener base 114 extends between the upper ends of the supports 110 and 112 at a location intermediate the saddle 30 and the gripper loop 80. A follower arm 115 is mounted on the support 110 for pivotal movement relative to the support and the opener base 114. An external cam follower 116 is fixed to the outer end of the follower arm 115. The external cam follower 116 is engageable with the stationary cam 100 when the opener 40 is adjacent to one of the feed stations 54.

A first gear wheel 120 is fixed to the follower arm 114 for movement with the follower arm. The first gear wheel 120 is in meshing engagement with a second gear wheel 122. The second gear wheel 122 is mounted on the support 110 for rotation relative to the opener base 114 about an axis 124.

An actuator shaft 130 is fixed for rotation with the second gear wheel 122. The actuator shaft 130 is supported on the opener base 114 for rotation relative to the opener base 114 about the axis 124. The actuator shaft 130 extends laterally through the opener base 114 for simultaneous actuation of three identical gripper assemblies 132, 134, and 136 on the opener.

Each one of the gripper assemblies 132–136 includes an internal cam 140 (FIG. 4) which is fixed to the opener base 114. The internal cam 140 has a non-circular outer periphery. Each one of the gripper assemblies 132–136 also includes a pivot block 142 which is fixed for pivotal movement with the actuator shaft 130 about the axis 124, relative to the opener base 114 and to the internal cam 140. The pivot block 142 has a gripping surface 146.

In each gripper assembly 132–136 a gripper carrier 148 is supported on the pivot block 142 for pivotal movement relative to the pivot block about an axis 150. An internal cam follower 156 on the gripper carrier 148 moves along the outer periphery of the internal cam 140 on the opener base 114 when the pivot block 142 pivots about the axis 124.

A gripper finger 152 is fixed on the gripper carrier 148. A biasing spring 154 acts between the gripper carrier 148 and the pivot block 142. The biasing spring 154 biases the gripper carrier 148, and thus the gripper finger 152, into a position relative to the pivot block 142 as shown in FIG. 3 in which the gripper finger 152 is closed on the gripping surface 146 on the pivot block.

In operation of the signature handling apparatus 10, the drive means 50 (FIG. 1) causes the signature openers 40 to move with the saddles 30, past the feed stations 54, in the direction 94. The signature openers 40 move in the direction 94 at twice the speed of the grippers 90 on the gripper loop 80. Thus, the signature openers 40 move at twice the speed of the signatures 60. Accordingly, as the signature openers 40 move along the path 52 past the gripper loop 80 (FIG. 2), the more rapidly moving signature openers, and the saddles 30, overtake and engage the more slowly moving signatures 60.

As each signature opener 40 moves past the gripper loop 80, the external cam follower 116 on the opener travels along the stationary cam 100 (FIG. 1). The engagement of the cam follower 116 with the stationary cam 100 results in pivoting movement of the follower arm 114 (FIG. 3) and rotation of the first gear wheel 120. The rotation of the first gear wheel 120 results in rotation of the second gear wheel 122 and the actuator shaft 130 about the axis 124. Rotation of the actuator shaft 130 results in pivoting movement of the pivot block 142 (FIGS. 4–5) in each one of the gripper assemblies 132–136 on the opener 40.

Within each one of the gripper assemblies 132–136, as the pivot block 142 pivots, the gripper carrier 148 moves with the pivot block. The internal cam follower 156 on the gripper carrier 148 travels along the non-circular outer periphery of the internal cam 140.

The internal cam follower 156 first moves radially inward toward the axis 150 as the pivot block 142 pivots, from the position illustrated by the opener **40*b* (FIG. 4) to the position illustrated by the opener 40*c*. The gripper carrier 148 pivots about the axis 150 relative to the pivot block 142. The gripper finger 152 on the gripper carrier 148 moves toward the gripping surface 146 on the pivot block 142. Within about the first 30° of pivoting movement of the pivot block 142, the gripper carrier 148 has pivoted far enough, relative to the pivot block 142, so that the long lap 66 of the signature 60 is gripped between the gripper finger 152 and the gripping surface 146 on the pivot block. The opener 40*c* (FIG. 4**) illustrates this position of the parts.

As the opener 40 travels farther along the stationary cam 100 past the gripper loop 80, the pivot block 142 continues to pivot relative to the opener base 114. As the pivot block 142 continues to pivot, the long lap 66 of the signature 60 is bent sharply and is drawn away from the short lap 68 by the pivoting movement of the gripper finger 152. In addition, the long lap 66 of the signature 60 is accelerated away from the short lap 68 because the signature opener 40 is moving in the first direction 94 twice as fast as the gripper 90. Thus, the short lap 68, which is moving at the slower speed of the gripper 90, falls behind the long lap 66, which is moving at the faster speed of the opener 40. This speed difference helps to separate the long lap 66 and the short lap 68 of the signature 60. The opener **40*d* (FIG. 4**) illustrates this position of the parts.

When the pivot block 142 has pivoted relative to the opener base 114 through about 150°, the internal cam follower 156 moves away from the axis 150. The gripper carrier 148 pivots about the axis 150 so that the gripper finger 152 moves away from the gripping surface 146 on the pivot block 142. The long lap 66 of the signature 60 is released from the opener 40. The opener **40*e* (FIG. 5**) illustrates this position of the parts.

At this point, the long lap 66 of the signature 60 is disposed on one side of the saddle 30—ahead of (to the right as viewed in FIG. 5) the apex 32 of the saddle. The short lap 68 of the signature 60 is disposed on the other side of the saddle 30—behind (to the left as viewed in FIG. 5) the apex 32 of the saddle.

The gripper 90 on the gripper loop 80 then releases the folded edge 62 of the signature 60. The signature 60 drops onto, or is deposited on, the saddle 30. The long lap 66 of the signature 60 and the short lap 68 of the signature are disposed on opposite sides of the saddle 30—that is, the signature is in an opened condition.

As each opener 40 reaches the downstream end of the stationary cam 100, its pivot block 142 returns to its starting condition illustrated by the opener 40*b* in FIG. 4. Thus, when each opener 40 moves to the next feed station 54 along the conveyor 12, the opener is in a condition to assist in opening another signature.

From the above description of the invention, those skilled in the art will perceive improvements, changes and modifications. For example, in order to stitch or otherwise process the assembled signatures 60, the signature openers 40 may be arranged relative to the saddles 30, in a manner not shown, so that the signature openers can move vertically or horizontally away from the saddles at some point along the conveyor 12. Such improvements, changes and modifications within the skill of the art are intended to be covered by the appended claims.

Having described the invention, I claim:

1. An apparatus comprising:

a plurality of saddles for receiving signatures from a plurality of signature feeding mechanism;

a plurality of signature openers, each one of said signature openers being associated with a respective one of said saddles; and means for moving said signature openers together with said saddles in a first direction along an endless path past the signature feeding mechanisms with said saddles extending transversely to said first direction;

each one of said signature openers having means for opening one respective signature as said one signature opener moves past a signature feeding mechanism to enable positioning of the one signature in an opened condition on the saddle associated with said one signature opener.

2. An apparatus as set forth in claim 1 wherein each one of the signatures has a long lap, a short lap, a folded edge and a lap edge, said means for opening of each one of said signature openers comprising means for gripping the long lap of one respective signature.

3. An apparatus as set forth in claim 2 wherein said means for gripping comprises means for accelerating the long lap of the signature away from the short lap of the signature.

4. An apparatus as set forth in claim 1 wherein each one of said signature openers comprises a base connected for movement with the saddle associated with said one signature opener, a pivot block supported on said base for pivotal movement relative to said base in response to movement of said one opener in the first direction past the signature feeding mechanism, and a gripper member supported on a pivot block for pivotal movement relative to said pivot block between an open condition and a closed condition in response to pivoting movement of said pivot block relative to said base.

5. An apparatus as set forth in claim 1 wherein said means for moving said signature openers together with said saddles comprises a conveyor having a series of links, each one of said links supporting a respective one of said signature openers and also supporting the saddle associated with said one signature opener.

6. An apparatus as set forth in claim 5 wherein each one of said openers comprises:

a base supported on a respective one of said links for movement with said link;

a pivot block supported on said base for pivotal movement relative to said base;

first cam means for effecting pivotal movement of said pivot block relative to said base in response to movement of said conveyor past the signature feeding mechanism;

a gripper member supported on said pivot block for pivotal movement relative to said pivot block; and second cam means for effecting pivotal movement of said gripper member relative to said pivot block between an open condition and a closed condition in response to pivoting movement of said pivot block relative to said base.

7. An apparatus as set forth in claim 5 wherein said conveyor is a closed loop conveyor having a linear portion extending past the signature feeding mechanism, said saddles moving together with said signature openers along said closed loop with said openers being disposed intermediate said saddles and said signature feeding mechanism.

8. An apparatus as set forth in claim 1 including a gripper loop comprising a plurality of signature grippers which deposit the signatures in an opened condition on said saddles, said signature openers moving at a first speed and being spaced apart from each other at uniform intervals of a first distance, said signature grippers moving at a second speed which is a predetermined fraction of said first speed, said signature grippers being spaced apart from each other at uniform intervals of a second distance which is said predetermined fraction of the first distance.

9. An apparatus as set forth in claim 8 wherein said second speed is about half of said first speed, said second distance being about half of said first distance.

10. An apparatus comprising:

a plurality of signature grippers for feeding a plurality of folded signatures;

a plurality of saddles for receiving the signatures from said signature grippers, said saddles being spaced apart from each other at uniform intervals of a first distance;

a plurality of signature openers spaced apart from each other at uniform intervals of said first distance, each one of said signature openers being associated with a respective one of said saddles;

means for moving said signature openers together with said saddles in a first direction along an endless path past said signature grippers at a first speed with said saddles extending transversely to said first direction;

said signature grippers being spaced apart from each other at uniform intervals of a second distance, said second distance being a predetermined fraction of said first distance; and means for moving said signature grippers at a second speed which is said predetermined fraction of said first speed;

each one of said signature openers having means for opening one respective signature as said one signature opener moves past the signature grippers to enable positioning of the one signature in an opened condition on the saddle associated with said one signature opener.

11. An apparatus as set forth in claim 10 wherein said second distance is about one half of said first distance and said second speed is about one half of said first speed.

12. An apparatus as set forth in claim 10 wherein said means for moving said saddles comprises a conveyor having a series of links, each one of said links supporting s respective one of said signature openers and the saddle associated with said one signature opener.

13. An apparatus as set forth in claim 10 wherein each one of the signatures has a long lap, a short lap, a folded edge and a lap edge, said means for opening on each one of said signature openers comprising means for gripping the long lap of one respective signature and for separating the long lap of the one signature from the short lap of the one signature and for accelerating the long lap away from the short lap.

14. An apparatus as set forth in claim 13 wherein each one of said signature openers comprises a base connected for movement with the saddle associated with said one signature opener, a pivot block supported on said base for pivotal movement relative to said base in response to movement of said one opener in the first direction past the signature feeding mechanism, and a gripper member supported on said pivot block for pivotal movement relative to said pivot block between an open condition and a closed condition in response to pivoting movement of said pivot block relative to said base.

* * * * *